US009816245B2

(12) United States Patent
Reinhardt

(10) Patent No.: US 9,816,245 B2
(45) Date of Patent: Nov. 14, 2017

(54) FILLING TUBE FOR PRODUCING A COLUMN OF FILLING MATERIAL IN THE GROUND AS WELL AS DEVICE AND METHOD RELATED THERETO

(71) Applicant: BAUER Spezialtiefbau GmbH, Schrobenhausen (DE)

(72) Inventor: Jens Reinhardt, Nordhausen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 15/173,944

(22) Filed: Jun. 6, 2016

(65) Prior Publication Data

US 2017/0002537 A1 Jan. 5, 2017

(30) Foreign Application Priority Data

Jul. 3, 2015 (EP) ..... 15175246

(51) Int. Cl.
*E02D 3/08* (2006.01)
*E02D 5/36* (2006.01)

(52) U.S. Cl.
CPC ..... *E02D 5/36* (2013.01); *E02D 3/08* (2013.01); *E02D 2250/0023* (2013.01); *E02D 2300/002* (2013.01); *E02D 2300/0079* (2013.01)

(58) Field of Classification Search
CPC ..... E02D 3/08; E02D 3/12
USPC ..... 405/240, 421
See application file for complete search history.

(56) References Cited

U.S. PATENT DOCUMENTS 4,126,007 A * 11/1978 Mars ..... E02D 3/08 405/240
6,592,300 B2 * 7/2003 Yang ..... E02D 5/385 405/239
6,672,408 B2 * 1/2004 Frantz ..... E02D 9/02 175/67

FOREIGN PATENT DOCUMENTS

DE 29611427 U1 * 9/1996 ..... E02D 3/08
DE 103 10 727 B4 9/2007
DE 102010001839 * 8/2011
GB 2311083 * 9/1997

* cited by examiner

*Primary Examiner* — Frederick L Lagman
(74) *Attorney, Agent, or Firm* — Studebaker & Brackett PC

(57) ABSTRACT

A filling tube for producing a column of filling material in the ground with a tube body. A closing device has at least one support element, which is arranged in a central region at a lower end of the tube body, and, in a closed position, closing flaps rest against the at least one support element.

11 Claims, 2 Drawing Sheets

Figure 1A:
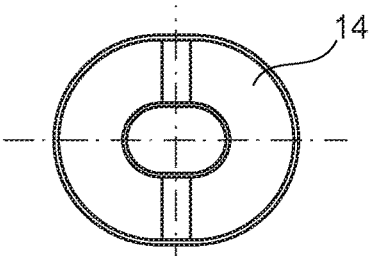

FILLING TUBE FOR PRODUCING A COLUMN OF FILLING MATERIAL IN THE GROUND AS WELL AS DEVICE AND METHOD RELATED THERETO

The invention relates to a filling tube for producing a column of filling material in the ground with a tube body, at the lower end of which a closing means with pivotably linked closing flaps is arranged, which, for the purpose of introducing the filling tube into the ground, assume a closed position, in which the tube body is closed in the downward direction and the closing flaps form a penetrating tip, and, on withdrawal of the filling tube from the ground, assume an open position, wherein the tube body is open in the downward direction and filling material can be fed from the tube body into the ground in order to form the column of filling material.

The invention further relates to a device for producing a column of filling material in the ground with a mast, along which a filling tube is movable in a substantially vertical manner, and a vibratory drive for installing the filling tube through vibration into the ground.

Moreover, the invention relates to a method for producing a column of filling material in the ground, in which a filling tube is introduced into the ground under application of vibrations and on withdrawal of the filling tube a closing means at the lower end of the filling tube is opened and a filling material is fed into the ground in order to form the column of filling material.

A generic prior art is known from DE 103 10 727 B4. With such a filling tube a filling material such as concrete, lime, gravel, sand, crushed stone or dry mortar can be introduced into soft or displaceable grounds. In this way, substantially vertical columnar bodies are produced in the ground.

Such a column of filling material can serve to stabilize and increase the load-bearing capacity of a building ground.

In contrast to bored piles, in which excavated ground material accumulates, columns of filling material can be produced efficiently and at low cost.

With a generic filling tube columns of filling material can in particular be produced in a step-by-step manner with a high compaction. Initially, the filling material tube is introduced into the ground using a vibrator. One tube end is closed by two closing flaps that form a penetrating tip in the closed state. After introduction of the filling tube up to a final depth the filling tube is withdrawn, whereby the closing flaps pivot open freeing up the tube opening. A first filling quantity can then be introduced into the ground. Through subsequent re-lowering of the filling tube the two closing flaps close through the effect of frictional forces so that the filling tube with the closed opening is able to compact the first filling material quantity introduced. Afterwards, the filling tube is lifted again, whereby the closing means re-opens due to the filling material present inside the tube and thus another quantity of filling material can be introduced into the hole in the ground. This process can be repeated until the column of filling material is completed.

The filling tube known from prior art with the lower closing means which, by itself, can fold in and out works very well for small and mid-size column diameters. In the case of larger column diameters, however, problems can arise during opening and closing of the filling tube. This can have a negative effect on the structure and stability.

The invention is based on the object to provide a filling tube as well as a device and a method for producing a column of filling material in the ground, with which a column of filling material can also be produced at a high quality level in the case of larger diameters.

According to the invention the object is achieved by a filling tube having the features of claim 1 and claim 5 and respectively by a method having the features of claim 13. Preferred embodiments of the invention are stated in the dependent claims.

The filling tube according to the invention for producing a column of filling material in the ground is characterized in that the closing means has at least one support element which is arranged in a central region at a lower end of the tube body and in that in the closed position the closing flaps rest against the support element.

A fundamental idea of the invention resides in the fact that the closing means and the closing elements for the lower tube opening are not formed by the closing flaps alone. According to the invention at least one support element is provided which supports the closing flaps at least in a central region in the closed position. Hence, the considerable forces that are absorbed by the closing flaps no longer have to be borne only by them and by a requisite shaping. The provision of one or several support elements thus permits a greater degree of freedom in the design of the closing flaps. Hence, considerably larger filling tube diameters as well as filling tube shapes that deviate from the circular shape can be provided.

Basically, the at least one support element can be covered completely by the closing flaps in the closed position. By preference, however, the at least one support element is arranged in such a manner that part of this is exposed in the closed position and the free surface forms part of the penetrating tip of the filling tube. This makes it possible to design the closing flaps in a smaller size even in the case of greater filling tube diameters, whereby a more reliable folding-out and folding-in of the closing means is rendered possible.

A particularly stable embodiment variant is accomplished in accordance with the invention in that the support element is designed as a beam-shaped bar which extends transversely across the lower end of the tube body and is fixed on both sides of the tube body. The support element can also be a cross-shaped bar that is substantially formed of two crossed beams.

According to the invention an alternative and equally stable embodiment can be achieved in that the support element is designed as a central shaft which is fixed via cross-braces on the tube body. The shaft can be designed in a substantially cylindrical or conical manner. In a top region the shaft can be fixed via radially extending cross-braces on an internal side of the tube body. By preference, three or more cross-braces are provided for this purpose.

Another preferred embodiment variant of the invention resides in the fact that the support element has at least one vertical end which is tapered and a curved lower end. The vertical end can be an upper tapered end directed towards the tube body. Such a tapering enables a good flow of the filling material past the support element. Alternatively or additionally, the tapered vertical end can also be the lower end directed towards the ground. In this case the tapering is preferably designed such that the tapered, in particular conical surfaces of the support element merge flush into the external surfaces of the closing flaps so that a penetrating tip enabling a most efficient introduction possible of the filling material tube into the ground is given. The support element can form the actual tip that has to absorb the highest forces during introduction into the ground. As a result, the closing flaps are closed.

According to the invention the object stated at the beginning is achieved alternatively in that the closing means has three or more closing flaps which are arranged so as to be distributed around the circumference of a lower edge of the tube body.

Through the arrangement of three or more closing flaps a reduced surface of the respective closing flap is achieved as compared to an arrangement with only two flaps. According to a finding of the invention a reliable opening and closing of the flaps is rendered more difficult with an increasing flap size. By arranging a plurality of closing flaps a reliable opening and closing motion is rendered possible for each closing flap. Even in the case of larger filling tube diameters this permits a safe opening and closing and thus a consistently good structure of a column of filling material. Moreover, the load exerted on each closing flap decreases with the number thereof. This protects the closing means and increases the service life of the filling material tube.

The arrangement of three or more closing flaps in accordance with the invention can also be provided in particular in combination with the previously described arrangement of at least one support element.

A preferred embodiment of the invention resides in the fact that four closing flaps are provided. In this way, an especially uniform, symmetrical load distribution of the closing flaps around the circumference can be achieved.

Basically, the closing flaps can be produced in different ways from a variety of different materials, in particular through casting. According to a further development of the invention an especially economical embodiment is achieved in that the closing flaps are formed of sheet steel. The closing flaps can be designed by forming a basic sheet metal or as a welded construction consisting of several sheet metal parts. The sheet steel design is particularly stable and can be produced at low cost.

Basically, it is possible that the closing flaps are each pivotably linked via several joint pins to the tube body. A preferred embodiment resides in the fact that the closing flaps are each pivotably connected via a joint pin to the tube body. As a result, the effort and expense involved in manufacturing is reduced. Especially on account of the amount of several closing flaps is it possible to reduce the size of an individual closing flap. As a result, the exerted forces are also reduced, thereby enabling a linkage with only one single joint pin on the tube body.

According to the invention the filling tube can basically have any desired cross sectional shape. By preference, the tube body is designed as a cylindrical tube which can generally be procured at low cost as a standard element. To produce columns of filling material of a particularly high load-bearing capacity a preferred embodiment of the invention resides in the fact that the tube body is of oval or angular design in cross section. In the case of an angular design provision can be made, in particular, for a square, rectangular or polygonal shape. Provision can also be made for other shapes that deviate from a circular shape, such as a cloverleaf shape with several partial circular arcs.

According to a further development of the invention it is particularly preferred that a diameter of the tube body amounts to 0.5 m or larger. Especially in the case of large tube diameters of 1 m and more a considerable load acts on the closing means so that the arrangement of a plurality of closing flaps proves to be particularly advantageous. Through this, the load of the individual flap and the pivot joint is kept limited so that a reliable opening and closing is ensured.

In another embodiment of the filling tube according to the invention it is advantageous to provide a funnel region with an enlarged diameter which is arranged at an upper end of the tube body. The funnel region serves for easier filling of the filling material, which can in particular be concrete, lime, gravel, sand, crushed stone, dry mortar or a different type of bulk material. According to the cross sectional shape of the tube body the funnel can also be of oval or angular design in cross section.

With regard to the device for producing a column of filling material in the ground the object stated at the beginning is achieved in accordance with the invention in that a filling tube according to the invention, as described above, is provided. The device can have a carrier implement, more particularly a crawler-type vehicle provided with the mast, along which the filling tube is movable in a substantially vertical manner. As carrier implement use can in particular be made of a so-called vibrator, as employed, for example, for installing sheet piles through vibration into the ground.

The invention furthermore comprises a method for producing a column of filling material in the ground, in which a filling tube is introduced into the ground under application of vibrations and on withdrawal of the filling tube a closing means at the lower end of the filling tube is opened and a filling material is fed into the ground in order to form the column of filling material, wherein the previously described filling tube is used in accordance with the invention.

The method enables columns of filling material of an especially high load-bearing capacity and compactness including those with larger diameters and deviating from a cylindrical shape to be produced in the ground.

Figure 1B:
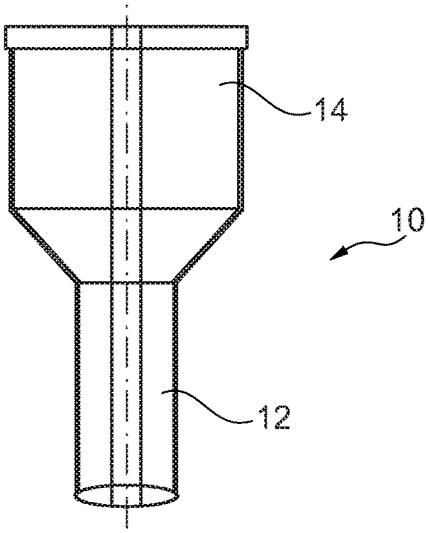
Figure 1C:
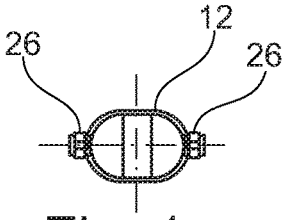
Figure 1D:
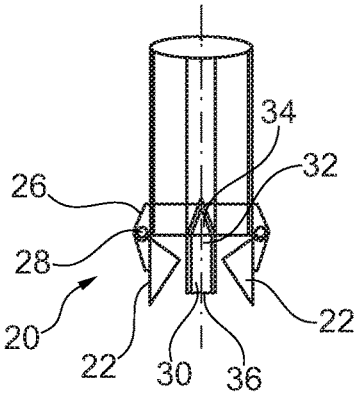
Figure 1E:
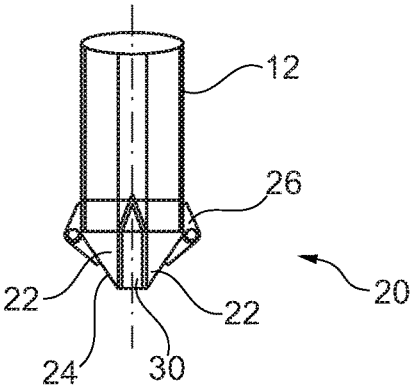
Figure 2A:
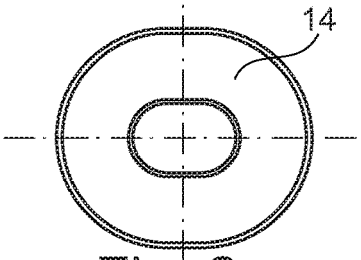
Figure 2B:
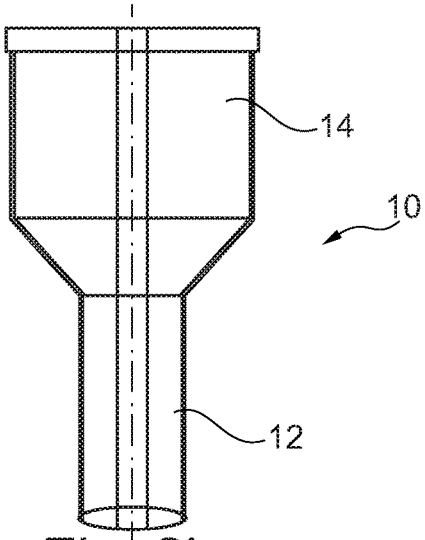
Figure 2C:
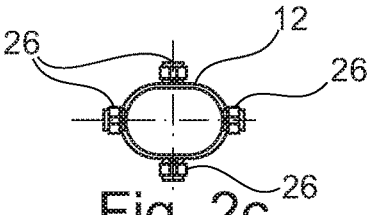
Figure 2D:
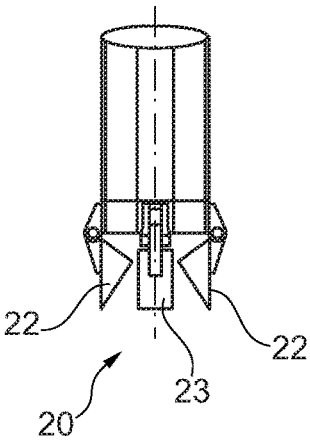
Figure 2E:
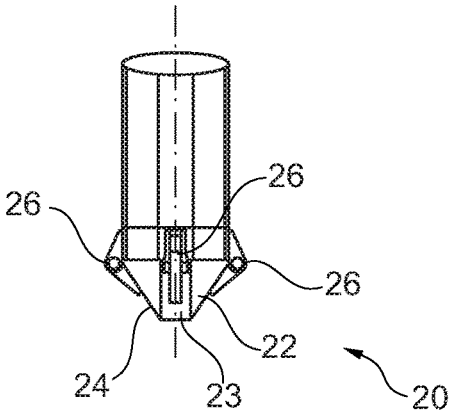

In the following the invention is described in greater detail by way of preferred embodiments illustrated schematically in the accompanying drawings, wherein show:

FIG. 1*a* a top view from above onto a first filling tube according to the invention;

FIG. 1*b* a schematic side view of an upper part of the first filling tube according to the invention;

FIG. 1*c* a cross sectional view of a tube body of the first filling tube according to the invention;

FIG. 1*d* a schematic side view of the lower part of the first filling tube according to the invention with the closing means being in an open position;

FIG. 1*e* a schematic side view according to FIG. 1*d* in a closed position of the closing means;

FIG. 2*a* a top view from above onto a second filling tube according to the invention;

FIG. 2*b* a schematic side view of an upper part of the second filling tube according to the invention;

FIG. 2*c* a cross sectional view of a tube body of the second filling tube according to the invention;

FIG. 2*d* a schematic side view of the lower part of the second filling tube according to the invention with the closing means being in an open position;

FIG. 2*e* a schematic side view according to FIG. 2*d* in a closed position of the closing means.

A first filling tube 10 according to the invention can be taken in a partially sectional and tilted view from FIGS. 1*a* to 1*e*. The first filling tube 10 according to the invention has a tube body 12 with an oval tube cross section. In an upper end region of the tube body 12 a funnel region 14 is provided that widens conically upwards and has an oval receiving section. The funnel region 14 serves to receive and fill in filling material to form the column of filling material. In particular, the filling material is a pourable medium, such as sand, gravel, lime, concrete etc.

At a lower end of the tube body 12 a closing means 20 with two closing flaps 22 is arranged. The closing flaps 22 are each linked to the tube body 12 via a pivot joint 26. The pivot joints 26 each have a joint pin 28 which is directed transversely to the tube axis and about which the respective shell-shaped closing flap 22 can be pivoted. The curved shell-shaped closing flaps 22 have a curvature in an axial view direction along the longitudinal filling tube axis.

In a central region of a lower opening of the tube body 12 a beam-shaped support element 30 is arranged which projects beyond the lower end of the tube body 12. The support element 30 is designed as a beam-shaped bar 32 that extends transversely through the oval tube body 12 and is fixed, in particular screwed on or welded to the internal side of the tube body 12. Through the beam-shaped bar 32 the lower opening of the tube body 12 is divided into two lateral opening regions.

In FIG. 1*d* the closing means 20 is shown in an open position, in which the closing flaps 22 free up the lower opening of the tube body 12 and hang down through the force of gravity. In this position, following introduction, in particular installation of the filling tube 10 through vibration into the ground, filling material can be fed via the open closing means 20 into the ground so as to form a column of filling material. For a reliable outflow of the pourable filling material an upper vertical end 34 of the support element 30 is designed in an upward tapered manner.

In FIG. 1*e* the closing means 20 is depicted in a closed position, in which the closing flaps 22 are folded radially inwards and rest flush against the central support element 30. Together with the said central support element 30, whose lower vertical end 36 is designed in a downward tapered manner, the closed closing flaps 22 thus form a penetrating tip 24. Through a simple downward pressing of the filling tube 10 into the ground the closing flaps 22 are pressed inwards against the support element 30 due to the present friction with the surrounding ground and held in the closed position to form the penetrating tip 24.

During a withdrawal and lifting of the filling tube 10 the arcuate closing flaps 22, due to friction on being withdrawn upwards and due to their weight, are again pivoted into the open position according to FIG. 1*d*.

In conjunction with FIGS. 2*a* to 2*e* a second filling tube 10 according to the invention is illustrated. The structure of tube body 12 and funnel region 14 corresponds to the first filling tube 10 according to the invention pursuant to FIG. 1.

In contrast to the first embodiment a different closing means 20 is provided that has a total of four closing flaps 22, 23. In addition to the shell-shaped closing flaps 22 two further lateral closing flaps 23 are provided along the oval sides of the tube body 12. The closing flaps 22, 23 are in each case fixed via pivot joints 26 at the lower end of the tube body 12 such that they lie opposite each other in pairs. Hence, a penetrating tip 24 tapering downwards to the ground is formed exclusively by the four closing flaps 22, 23, as depicted in FIG. 2*e*. In this, the two lateral closing flaps 23 touch each other while the two shell-shaped closing flaps 22 are spaced apart in the closed position and rest against the lateral closing flaps 23. The shape of the closing flaps 22, 23 formed of sheet steel is adjusted such that these rest flush against each other in the closed position according to FIG. 2*e* in order to form the penetrating tip 24.

Since the closing mechanism is distributed over more than two closing flaps 22, 23 the load present on the individual closing flap 22, 23 is kept limited and even in the case of larger diameters of the tube body 12 a reliable opening and closing of the closing means 20 is ensured solely by the weight force of the closing flaps 22, 23 and through friction with the surrounding ground respectively.

The invention claimed is:

1. Filling tube for producing a column of filling material in the ground with a tube body, at the lower end of which pivotably linked closing flaps are arranged, which, on introduction of the filling tube into the ground, assume a closed position, in which the tube body is closed in the downward direction and the closing flaps form a penetrating tip, and, on withdrawal of the filling tube from the ground, assume an open position, wherein the tube body is open in the downward direction and filling material can be fed from the tube body into the ground in order to form the column of filling material, wherein the closing flaps have at least one support element, which is arranged in a central region at a lower end of the tube body, in the closed position the closing flaps rest against the support element, the support element is designed as a central shaft, which is vertically arranged and fixed via cross-braces on the tube body, the support element has at least one upper vertical end, which is tapered, and a curved lower end, the closing flaps are curved shell-shaped closing flaps, the curved shell-shaped closing flaps comprise a curvature in an axial view direction along the longitudinal filling tube axis, the curved shell-shaped closing flaps provide for an oval shape in a cross sectional view along the longitudinal axis of the filling tube in a closed position, and the support element is tapered in an upward direction.

2. Filling tube according to claim 1, wherein the support element is designed as a beam-shaped bar, which extends transversely across the lower end of the tube body and is fixed on both sides of the tube body.

3. Filling tube according to claim 1, wherein the closing flaps have three or more closing flaps, which are arranged so as to be distributed around the circumference of a lower edge of the tube body.

4. Filling tube according to claim 1, wherein four closing flaps are provided.

5. Filling tube according to claim 1, wherein the closing flaps are formed of sheet steel.

6. Filling tube according to claim 1, wherein the closing flaps are each pivotably connected via a joint pin to the tube body.

7. Filling tube according to claim 1, wherein the tube body is of oval or angular design in cross section.

8. Filling tube according to claim 1, wherein a diameter of the tube body amounts to 0.5 m or larger.

9. Filling tube according to claim 1, wherein a funnel region with an enlarged diameter is provided, which is arranged at an upper end of the tube body.

10. Device for producing a column of filling material in the ground with a mast, along which a filling tube is movable in a substantially vertical manner, and a vibratory drive for installing the filling tube through vibration into the ground, wherein a filling tube according to claim 1 is provided.

11. Method for producing a column of filling material in the ground, the method comprising:

introducing a filling tube into the ground under application of vibrations, on withdrawing the filling tube, opening closing flaps at the lower end of the filling tube and feeding a filling material into the ground in order to form the column of filling material, and using a filling tube according to claim 1.

* * * * *